US006450141B1

(12) United States Patent
Sakuma

(10) Patent No.: US 6,450,141 B1
(45) Date of Patent: Sep. 17, 2002

(54) INTAKE NOISE REDUCING DEVICE FOR INTERNAL COMBUSTION ENGINE

(75) Inventor: Yuuichi Sakuma, Kanagawa-ken (JP)

(73) Assignee: Nissan Motor Co., Kanagawa-ken (JP)

( * ) Notice: Subject to any disclaimer, the term of this patent is extended or adjusted under 35 U.S.C. 154(b) by 0 days.

(21) Appl. No.: 09/108,704

(22) Filed: Jul. 1, 1998

(30) Foreign Application Priority Data

Jul. 3, 1997 (JP) ..... 9-178495

(51) Int. Cl.[7] ..... F02M 35/10

(52) U.S. Cl. ..... 123/184.57; 123/184.56; 181/229

(58) Field of Search ..... 123/184.56, 184.57; 181/229

(56) References Cited

FOREIGN PATENT DOCUMENTS

| | | |
|---|---|---|
| JP | 03290052 | 12/1991 |
| JP | 3-290052 | 12/1991 |
| JP | 4-8861 | 1/1992 |
| JP | 04008861 | 1/1992 |
| JP | 06123260 | 5/1994 |
| JP | 07042638 | 2/1995 |
| JP | 08158970 | 6/1996 |
| JP | 09004529 | 1/1997 |

*Primary Examiner*—Noah P. Kamen
(74) *Attorney, Agent, or Firm*—McDermott, Will & Emery

(57) ABSTRACT

A continuous partition wall is formed in the air introducing duct. The air introducing duct has a length L. The partition wall has a length equal to or greater than L/2. The partition wall divides the air introducing duct into first and second sections. A resonance silencer and a connecting duct are connected to the first section. A connecting position of the resonance silencer and the connecting duct is set such that the connecting position is fully included within a partition wall positioned range. A valve is arranged in the second section. Thus, intake noises is decreased in a wide range from a low frequency about 40 Hz to an intermediate frequency about several hundred Hz, which is normally hearable.

17 Claims, 11 Drawing Sheets

FIG.12

IMPROVING EFFECTS OF SILENCING CHARACTERISTICS OF AN INTAKE SYSTEM IN WHICH A RESONANCE SILENCER IS ARRANGED IN A POSITION 100 mm APART FROM A FRONT END OF AN EXTERNAL AIR INTRODUCING DUCT HAVING 300 mm IN LENGTH

| POSITION OF PARTITION WALL | No. | LENGTH OF PARTITION WALL | PROBLEM FREQUENCY HAVING INSUFFICIENT SILENCING AMOUNT: ● 30~40Hz | ▨ 80~90Hz | ○ 100~110Hz |
|---|---|---|---|---|---|
| THE PARTITION WALL IS FORMED ON A BASE END SIDE AND AN OPENING-CLOSING VALVE IS CLOSED | (2) | 1/4L | 4dB | 2dB | 7dB |
| | (3) | L/2 | 5dB | 2dB | 11dB |
| | (4) | 3/4L | 13dB | 12dB | 11dB |
| THE PARTITION WALL IS FORMED ON AN INTERMEDIATE SIDE AND THE OPENING-CLOSING VALVE IS CLOSED | (5) | 1/4L | 4dB | 1dB | 5dB |
| | (6) | L/2 | 7dB | 4dB | 14dB |
| | (7) | 3/4L | 10dB | 8dB | 13dB |
| THE PARTITION WALL IS FORMED ON A FRONT END SIDE AND THE OPENING-CLOSING VALVE IS CLOSED | (8) | 1/4L | 4dB | 1dB | 7dB |
| | (9) | L/2 | 7dB | 2dB | 14dB |
| | (10) | 3/4L | 9dB | 6dB | 12dB |

INTAKE NOISE REDUCING DEVICE FOR INTERNAL COMBUSTION ENGINE

The content of Application No. TOKUGANHEI 9-178495 filed Jul. 3, 1997, in Japan is hereby incorporated by reference.

BACKGROUND OF THE INVENTION

The present invention relates to a noise reducing device for an internal combustion engine of an automobile, etc., and particularly relates to an intake noise reducing device capable of improving comfortableness by reducing noises of an intake system.

In a related intake system, an air introducing duct is divided into two sections and a valve is attached to one duct of the sections. The valve is opened and closed in accordance with a change of engine speed, etc. (See Japanese Laid-Open Patent Nos. 3-290052 and 4-8861.)

SUMMARY OF THE INVENTION

In one of the above related intake systems, a resonance silencer is formed by closing the valve in low speed rotation so that silencing effects with respect to a specific frequency are obtained (see Japanese Laid-Open Patent No. 3-290052). In the other, duct resonance from 200 to 300 Hz is reduced by a side branch (Japanese Laid-Open Patent No. 4-8861). Therefore, it is difficult to sufficiently reduce noises in a wide frequency range from a lower frequency.

The present invention is achieved with such points in view. It therefore is an object of the present invention is to provide an intake noise reducing device for an internal combustion engine capable of silencing noises in a wide range from a low frequency to an intermediate frequency, which is normally hearable by a human being.

An intake noise reducing device for an internal combustion engine in the present invention has a duct, a partition wall, a silencer, a connecting duct and a valve. The duct introduces air into an internal combustion engine and has a length L. The partition wall is arranged within the duct to divide into first and second sections and has a length equal to or greater than L/2. The connecting duct connects the first section and the silencer. A connecting position of the connecting duct to the duct is in opposite to the partition wall. The valve opens and closes the second section.

In the above construction, for low engine loads, the valve of the second section is closed. As a result, the silencing effects are increased in a frequency area from low to high. Accordingly, silencing performance is greatly improved over a wide range of frequency and the intake noises are greatly reduced and quietness is improved in an ordinary low load driving condition in which operating frequency is high.

For high engine loads, the valve of the second section is opened. As a result, a required engine output is secured and excellent silencing performance is exhibited in comparison with a conventional structure having no partition wall.

Accordingly, silencing performance is greatly improved over a wide range of frequency and intake noises are greatly reduced.

BRIEF DESCRIPTION OF THE DRAWING

FIG. 12 is a table for explaining improvements of silencing effects with respect to frequencies.

DESCRIPTION OF THE PREFERRED EMBODIMENTS

Figure 1:
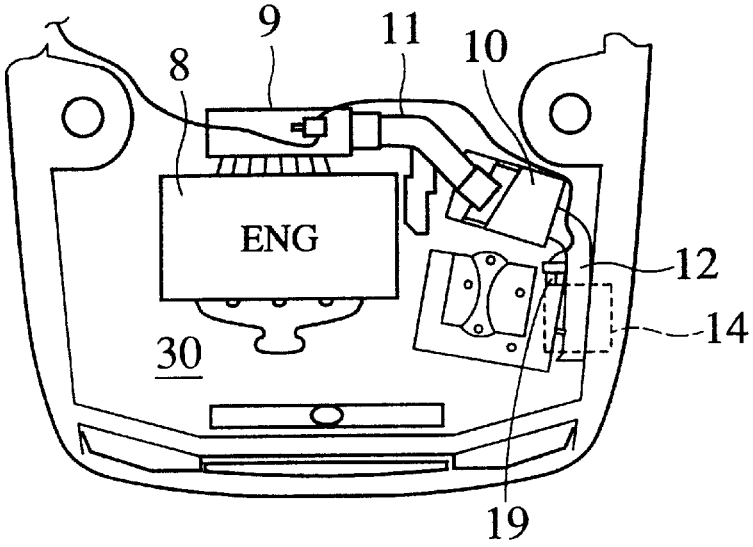
FIG. 1 is a plan view of an engine room showing a first embodiment of the present invention.

The preferred embodiments of the invention is described next. In the following explanation, equivalent members are designated by the same reference characters, and only different members are designated by different reference characters. Further, upwardness and downwardness in the explanation correspond to directions in the drawings.

FIGS. 1 to 5 are views showing an intake noise reducing device in a first embodiment of the invention.

A whole structure of the intake noise reducing device is explained with reference to FIG. 1.

An engine 8, an intake-air collector 9, an air cleaner 10, a clean side duct 11, an air introducing duct 12, a resonance silencer 14, and a vacuum actuator 19, etc. are arranged within an engine room 30 of an automobile. The intake-air collector 9 and the air cleaner 10 are connected to each other via the clean side duct 11. The air introducing duct 12 extends forward from the air cleaner 10.

Figure 2:
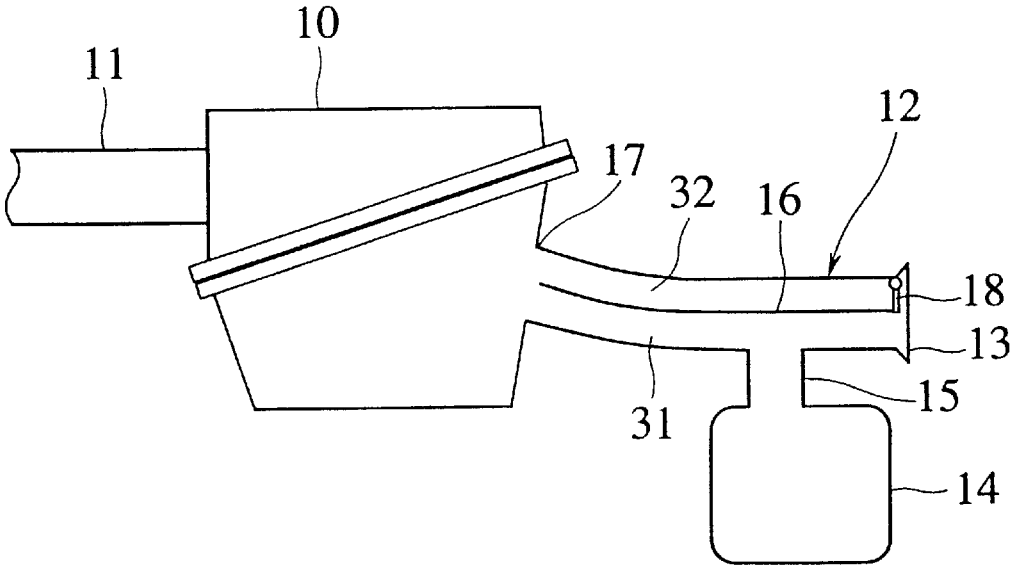
FIG. 2 is a cross-sectional view showing an intake noise reducing device in the first embodiment.
Figure 3:
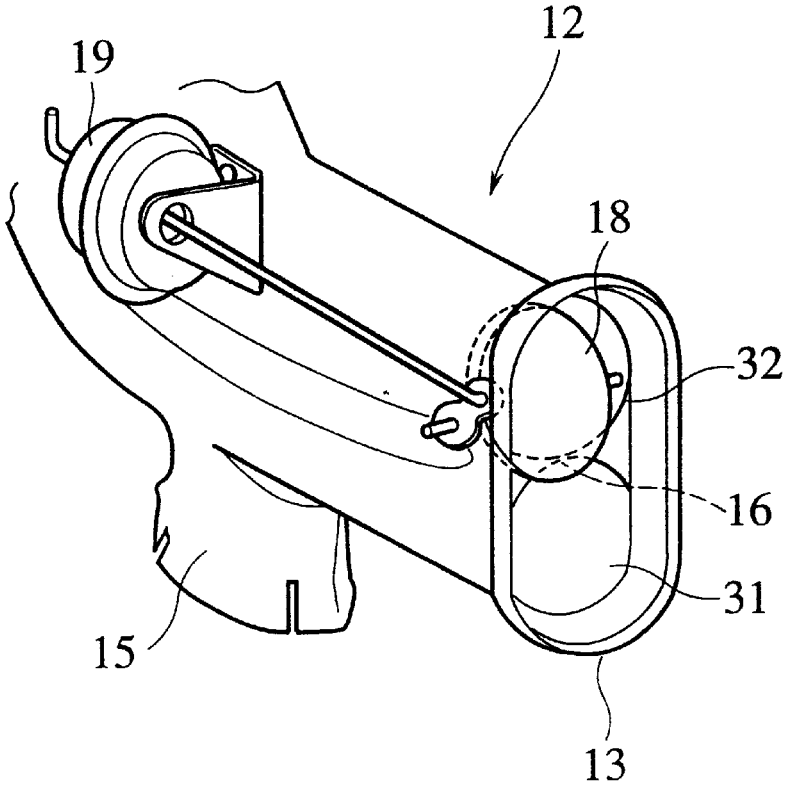
FIG. 3 is a perspective view showing an air introducing duct in the first embodiment.
Figure 4:
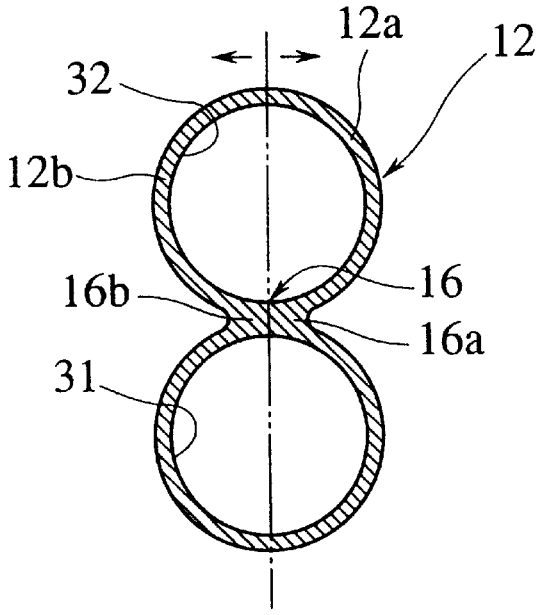
FIG. 4 is a cross-sectional view of the air introducing duct in the first embodiment.

A structure of the air introducing duct 12 is explained with reference to FIGS. 2 to 4.

The air introducing duct 12 has a length L. A partition wall 16 is formed within the air introducing duct 12. The partition wall 16 has the length L and extends from a front end 13 of the air introducing duct 12 to a base end 17 thereof. The partition wall 16 divides the air introducing duct 12 into a first section 31 on a lower side and a second section 32 on an upper side. A butterfly valve 18 is arranged to the second section 32 at the front end 13. The vacuum actuator 19 operates the valve 18 to close the second section 32 when the load on the engine 8 is low and to open when the load is high. FIG. 4 shows a sectional shape of a position including the partition wall 16 of the air introducing duct 12. The air introducing duct 12 is constructed by two parts 12*a*, 12*b* on left and right sides in the FIG. 4. The air introducing duct 12 is entirely formed in the shape of a number "8" in section such that each of the first and sections 31, 32 has a substantially oval-shaped cross-section. The partition wall 16 is formed by central joining members 16*a*, 16*b* of the parts 12*a*, 12*b*.

The resonance silencer 14 is connected to the first section 31 via a connecting duct 15 in a position about 2L/5 apart from the front end 13. Accordingly, an connecting position of the connecting duct 15 to the air introducing duct 12 fully included within an arranging range of the partition wall 16.

The above construction is used because it has become clear, as a result of a silencing characteristic measuring experiment in a structure changed with the length of the partition wall 16 as a parameter, that the length of the partition wall 16 must be equal to or greater than L/2 to obtain silencing effects greatly at a low frequency equal to or smaller than 100 Hz. Further, the above construction is used because it has become clear that the connecting position of the connecting duct 15 to the resonance silencer 14 must be in opposite to the partition wall 16.

An operation of the intake noise reducing device in the first embodiment is explained next.

For low engine loads, intake air amount is small and an intake air resistance is small. Thus, the second section 32 does not need intake air, so the valve 18 is closed by the vacuum actuator 19. Therefore, the air introducing duct 12 becomes equivalent to a duct having reduced cross-sectional area. Consequently, silencing characteristics at a low frequency obtained by the air cleaner 10 are improved and the silencing effects are increased in a frequency area from a low frequency about 40 Hz to a high frequency. Further, the connecting position of the connecting duct 15 to the air introducing duct 12 is fully included within the arranging range of the partition wall 16 so that the connecting duct 15 is connected to the first section 31 having reduced cross-sectional area. Therefore, the intake noise reducing device attains a state equivalent to a state in which air flows from a duct having a small diameter into the connecting duct. As a result, effects of the resonance silencer 14 are improved and silencing effects are simultaneously greatly increased in an frequency area equal to or higher than a resonance frequency, e.g., in a frequency equal to or higher than 80 Hz. By these two actions, intake noises from a low frequency to an intermediate frequency as a possibility of causes of confined sounds within a vehicle room are effectively reduced.

Figure 5:
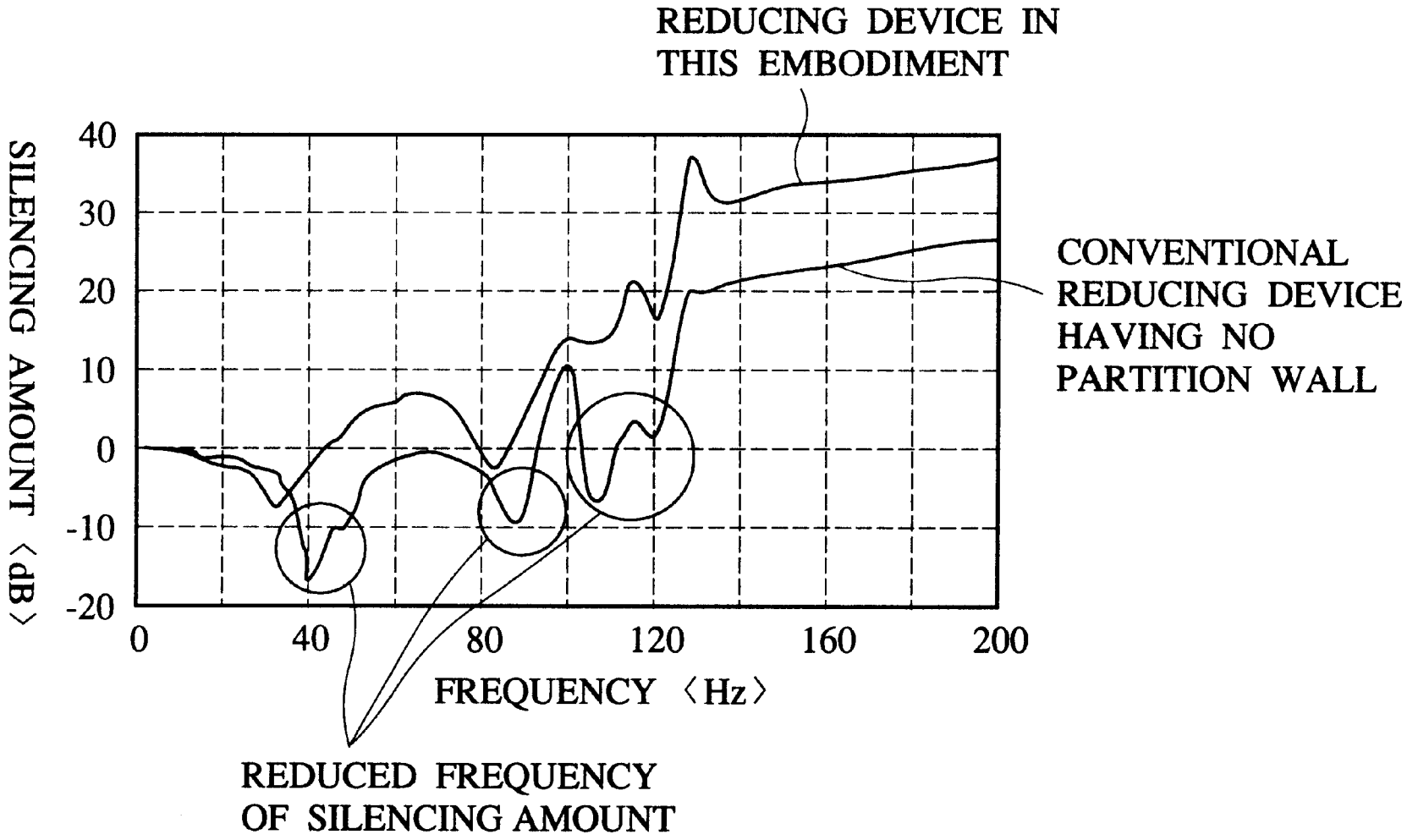
FIG. 5 is a graph showing silencing characteristic data in the first embodiment.

FIG. 5 shows results of silencing performance as an intake system obtained by applying this embodiment to the intake system of a front-wheel-drive 2000 cc class vehicle. In FIG. 5, high performance is expressed by high silencing amount revel. FIG. 5 shows frequencies up to 200 Hz. However, it is actually confirmed that the silencing performance is greatly improved up to 250 Hz and is also greatly improved in a frequency range from 300 Hz to 500 Hz.

Accordingly, the silencing amount is increased equal to or greater than 10 dB in a frequency range from a lower level near 40 Hz.

In contrast to this, for high engine loads, intake air amount is large, so the second section 32 needs intake air. It is particularly necessary to reduce a intake resistance in a high speed rotating area of the engine 8. Accordingly, the valve 18 is opened in a high load with the intake air amount, the engine speed, etc. as a judging standard. Thus, air also flows into the second section 32 so that the intake resistance is reduced and the engine 8 generates a sufficient output.

With respect to the intake noises, a phase difference between sounds propagated in the first and second section 31, 32 is caused. Thus, slight noise reducing effects are provided on a lower frequency side than a design frequency of the resonance silencer 14 and effects of a frequency shift equivalent to an increase in volume of a resonance chamber are provided. As a result, a degree of freedom of a silencer arrangement is increased within an engine room 30 having a limited space and excellent silencing performance is exhibited in comparison with a conventional structure having no partition wall.

An experiment made to decide a preferable length of the partition wall and an connecting range of the connecting duct is explained by referring FIGS. 6 to 13. Similar members is explained by using the same reference characters even when lengths and positions of these characters are respectively different from each other.

Figure 6:
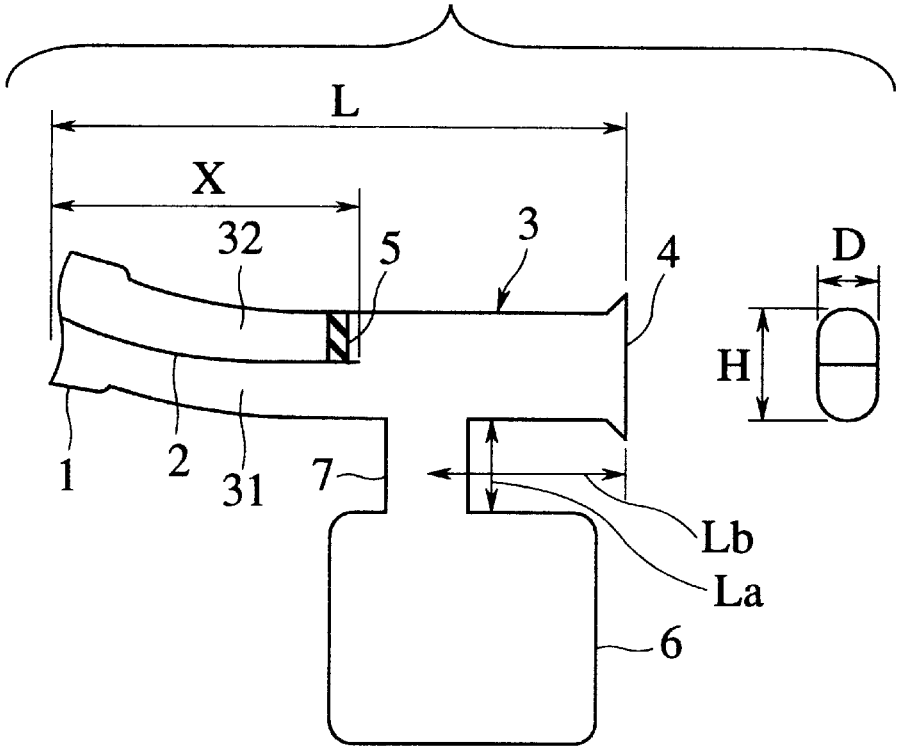
FIG. 6 is a cross-sectional view showing a structure in which a partition wall is offset to a base end of the air introducing duct for investigating a change in silencing characteristics as a length of the partition wall and a position of a connecting duct are changed.

FIG. 6 shows an air introducing duct 3 of a first example. In the first example, a partition wall starting point is set to a base end 1 on an air cleaner side. An entire length L of the air introducing duct 3 is set to 300 mm. The air introducing duct 3 is set to 76 mm in height H and 40 mm in width D. A connecting duct 7 is set to 50 mm in length La and a distance Lb from a front end 4 of the air introducing duct 3 to a center of the connecting duct 7 is set to 100 mm. The air introducing duct 3 is separated into a first section 31 and a second section 32 by the partition wall 2. A resonance silencer 6 is arranged in the first section 31 through the connecting duct 7. The second section 32 is closed by a closing member 5 arranged in the second section 32 and offset to the front end 4.

Figure 7:
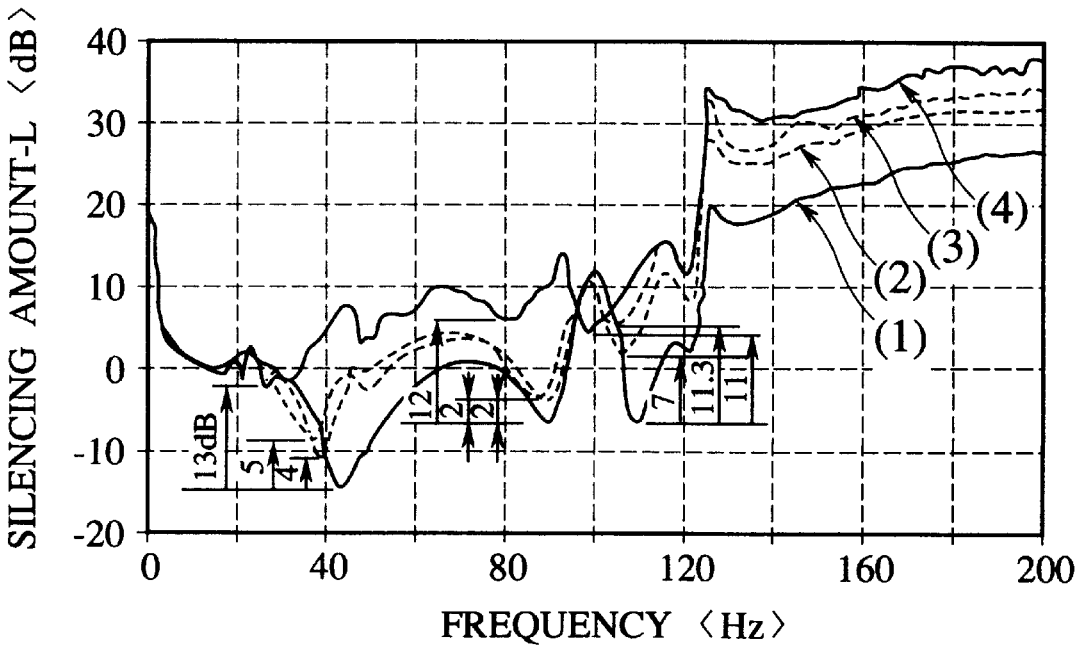
FIG. 7 is a graph showing silencing characteristics of the air introducing duct of FIG. 6.

The experiment is made with respect to three kinds of lengths X of the partition wall 2, 75 mm (L/4), 150 mm (L/2)

and 225 mm (3L/4). In FIG. 7, Nos. (2), (3) and (4) respectively show experimental results of X=75 mm, 150 mm and 225 mm. When the length X of the partition wall 2 is 75 mm and 150 mm, no partition wall 2 reaches the connecting duct 7 of the resonance silencer 6. When the length X of the partition wall 2 is 225 mm, a connecting position of the connecting duct 7 is fully included in a partition wall positioned range.

Figure 8:
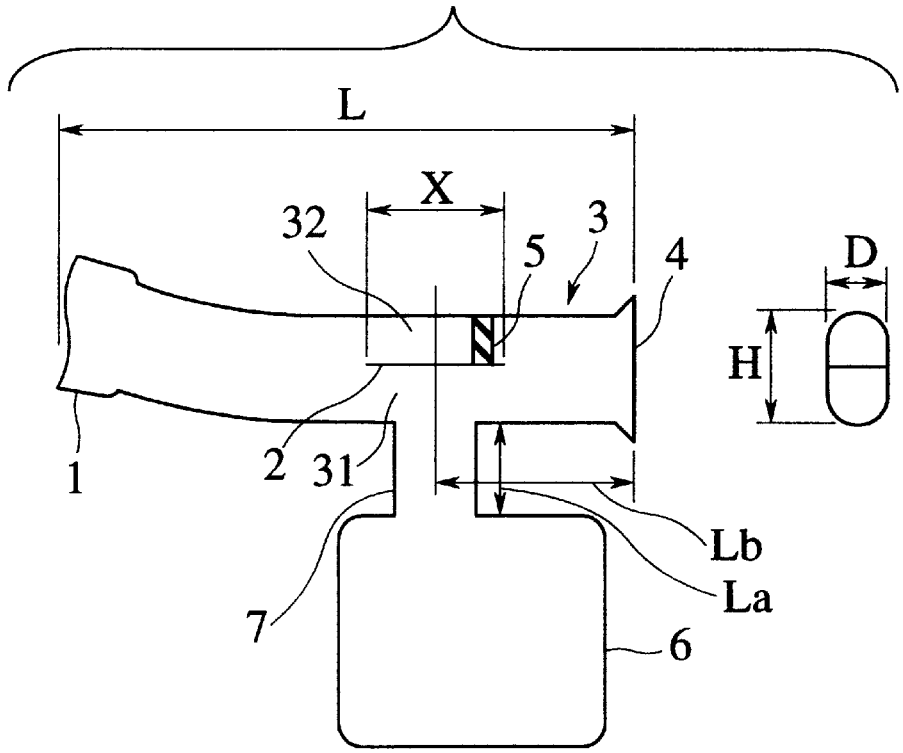
FIG. 8 is a cross-sectional view showing a structure in which a partition wall is arranged in an intermediate position of the air introducing duct.
Figure 9:
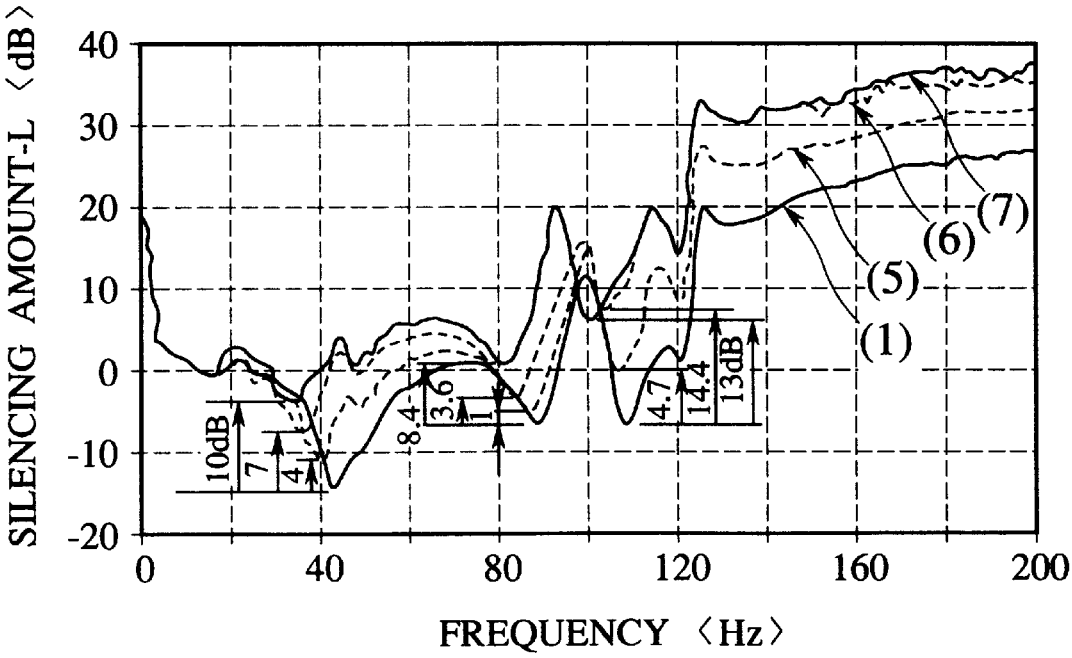
FIG. 9 is a graph showing silencing characteristics of the air introducing duct of FIG. 8.

FIG. 8 shows a second example. In the second example, the partition wall 2 is formed in an intermediate range including a connecting position of the connecting duct 7. An experiment of the second example is made with respect to three kinds of lengths X of the partition wall 2, 75 mm, 150 mm and 225 mm. In FIG. 9, Nos. (5), (6) and (7) respectively show experimental results of X=75 mm, 150 mm and 225 mm. In this case, each the connecting positions of the connecting ducts 7 is fully included in a partition wall positioned range.

Figure 10:
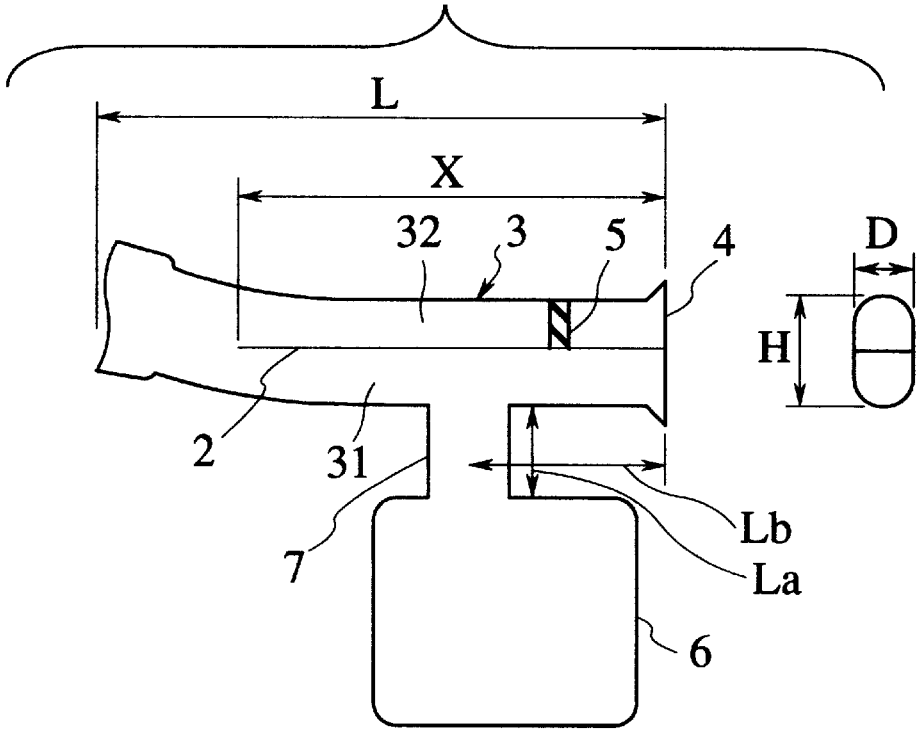
FIG. 10 is a cross-sectional view showing a structure in which the partition wall is offset to a front end of the air introducing duct.
Figure 11:
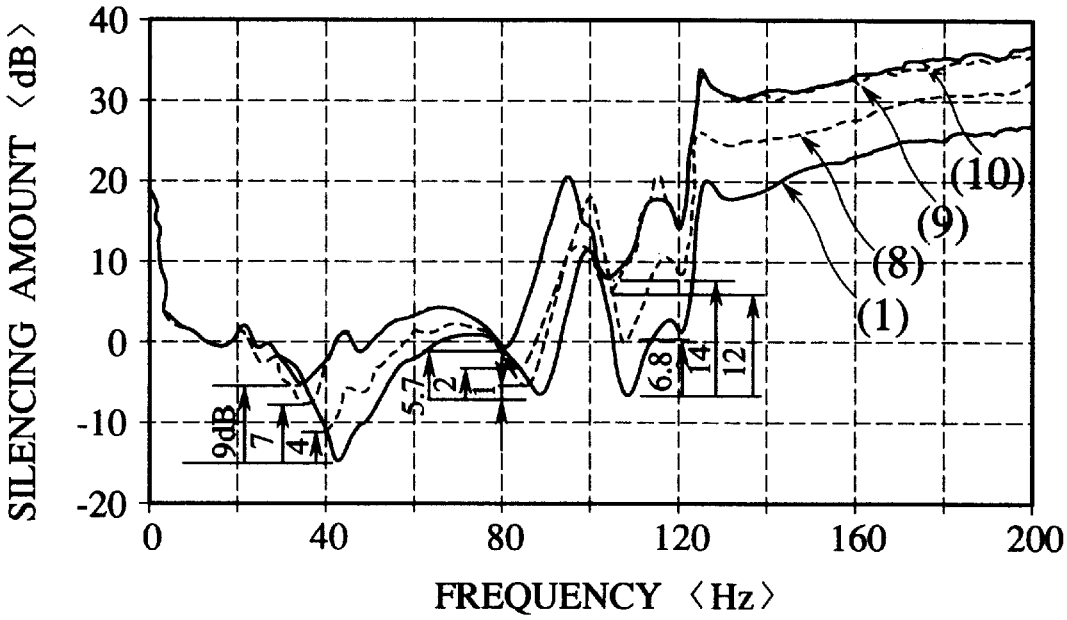
FIG. 11 is a graph showing silencing characteristics of the air introducing duct of FIG. 10.

FIG. 10 shows a third example. In the third example, a partition wall starting point is set to a front end 4 of an air introducing duct 3. An experiment of the third example is made with respect to three kinds of lengths X of the partition wall 2, 75 mm, 150 mm and 225 mm. In FIG. 11, Nos. (8), (9) and (10) respectively show experimental results of X=75 mm, 150 mm and 225 mm. When the length X of the partition wall 2 is 75 mm, no partition wall 2 reaches the connecting range of a connecting duct 7. When the length X of the partition wall 2 is 150 mm and 225 mm, each the connecting positions of the connecting ducts 7 is fully included in a partition wall positioned range.

The experimental results are shown in the graphs of FIGS. 7, 9 and 11. In these graphs, No. (1) is a silencing characteristic comparing example. In the comparing example, an air introducing duct has the same basic size as each of the above examples and has no partition wall (X=0 mm). From these graphs, it should be understood that silencing performance is greatly changed in a wide range including three frequency areas in which an internal sound of the vehicle tends to be caused. These performance differences are summarized in the table of FIG. 12 with respect to three noted frequencies.

In FIG. 12, values express the amount of the silence effects, the circled values show the better performance. Range of the connecting duct 7 of the circled values are within a partition wall positioned range. So it is effective to layout the connecting duct 7 facing to the partition wall 2.

Figure 13:
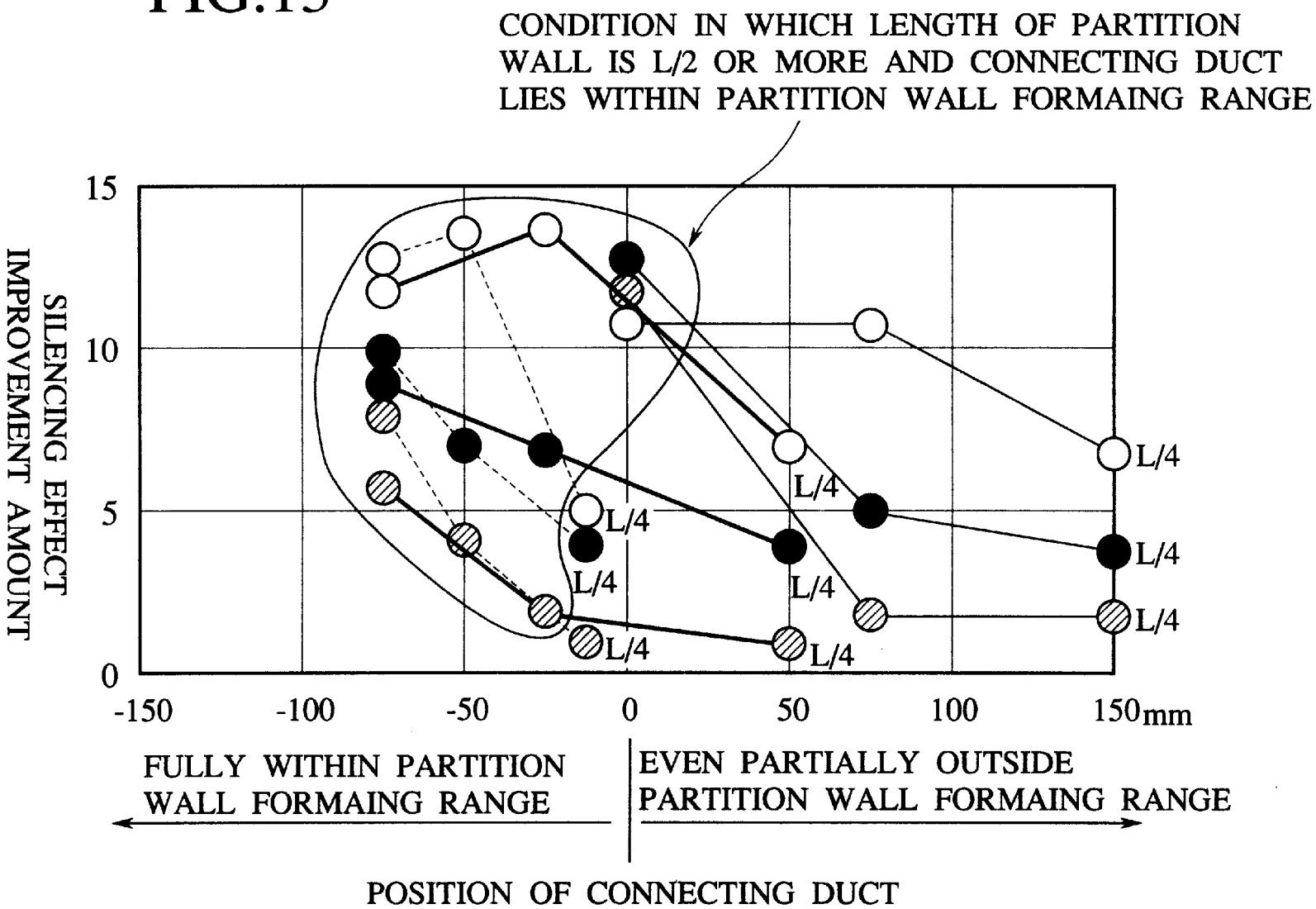
FIG. 13 is a view for comparing the silencing effects summarized in the position of the connecting duct.

FIG. 13 shows a graph in which the connecting position of the connecting duct 7 is shown on the abscissa and a silencing effect improvement amount is shown on the ordinate. From FIG. 13, high silencing effects are shown in a condition in which the length of the partition wall 2 is equal to or longer than L/2 and the connecting position of the connecting duct 7 is fully included within the partition wall positioned range. An average improving amount of the silencing effects in a way satisfying the condition is about 9.5 dB and is therefore very high. In contrast to this, the average improving amount of the silencing effects is about 4.4 dB and is therefore not so high in a way in which the length of the partition wall 2 is L/4 or the connecting position of the connecting duct 7 is partially or fully departed from the partition wall positioned range.

Accordingly, it is necessary to greatly improve the silencing effects that the length of the partition wall 2 is set to be equal to or greater than a length half the entire length L of the air introducing duct 3 and the connecting position of the connecting duct 7 is fully included in the partition wall positioned range.

As explained above, in accordance with the embodiment, by closing the valve 18 of the second section 32 in driving conditions resulting from a constant speed or a slow acceleration of a low load in which driving frequency is high and a continuous time is long, silencing effects of the air cleaner 10 and the resonance silencer 14 at low and intermediate frequencies are improved, intake noises are greatly reduced and comfortableness is improved. Further, by opening the valve 18 of the second section 32 in high load conditions resulting from a sudden acceleration, an ascent, etc, the intake resistance of an intake system is reduced and a required engine output is secured. Accordingly, quietness is improved and the engine output is secured in accordance with the driving conditions. Further, great silencing effects are obtained in a low frequency area equal to or lower than 100 Hz since the length of the partition wall 16 is set to be equal to or longer than L/2 with respect to the length L of the air introducing duct 12.

Figure 14:
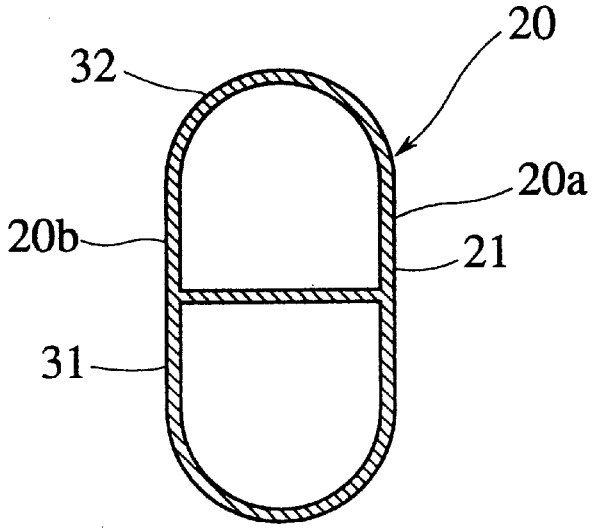
FIG. 14 is a cross-sectional view of an air introducing duct in a second embodiment of the present invention.

FIG. 14 is a view showing a second embodiment of the invention. In the second embodiment, an air introducing duct 20 has a substantially oval-shaped cross-section and a partition wall 21 having a flat plate shape is arranged at a center of the air introducing duct 20. The air introducing duct 20 is formed by two parts 20*a*, 20*b* divided on left and right sides in FIG. 14. Accordingly, the same cross-sectional area as the first embodiment can be attained by smaller space than the first embodiment.

Figure 15:
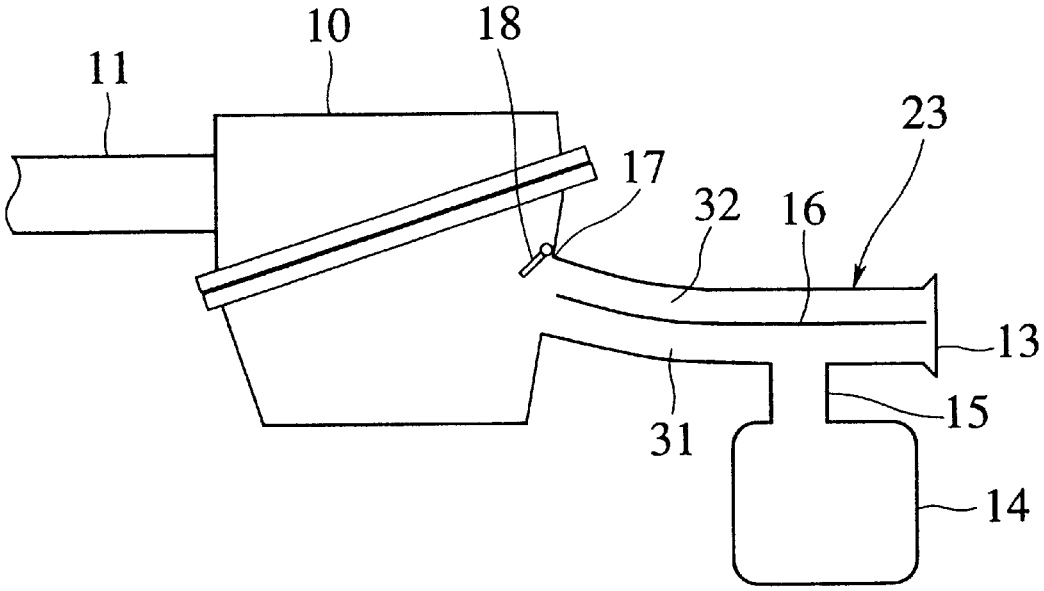
FIG. 15 is a cross-sectional view showing an intake noise reducing device in a third embodiment of the present invention.

FIG. 15 is a view showing a third embodiment of the invention. In the third embodiment, a partition wall 16 has a length similar to that in the first embodiment. However, in contrast to the first embodiment, an valve 18 is arranged at a base end 17 of a air introducing duct 22. In accordance with the third embodiment, no parts of the valve 18 are influenced by rainwater, etc. and durability is excellent as merits in comparison with a case in which the valve 18 is arranged at a front end 13 of the air introducing duct 22. Further, a space within the air cleaner 10 is utilized in the attachment of the valve 18 so that the valve 18 is stored in the same space as a conventional intake structure having no partition wall. Therefore, it is possible to embody the third embodiment without causing a great change in layout within an engine room, etc.

Figure 16:
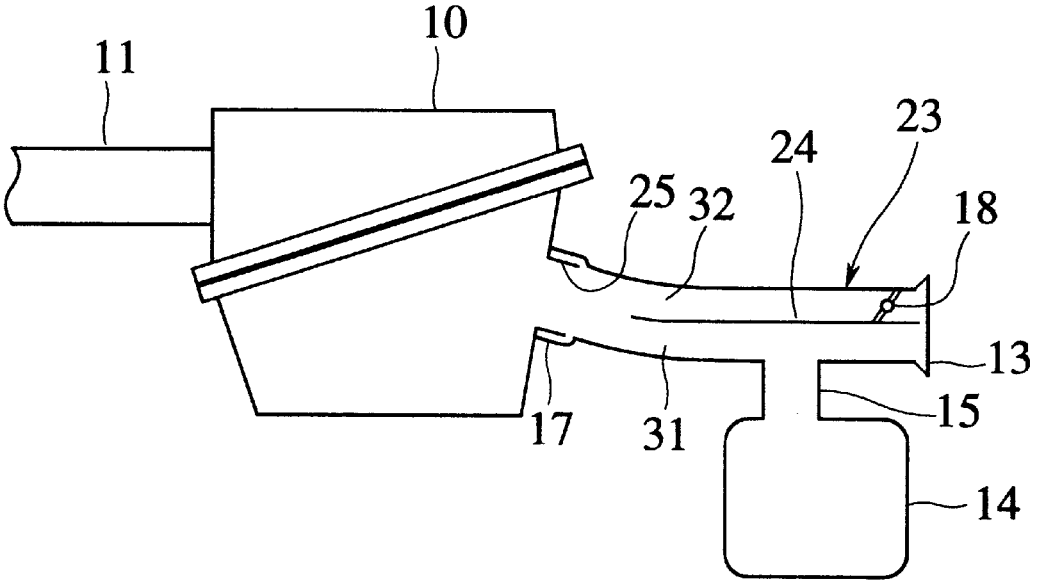
FIG. 16 is a cross-sectional view showing an intake noise reducing device in a fourth embodiment of the present invention.
Figure 17:
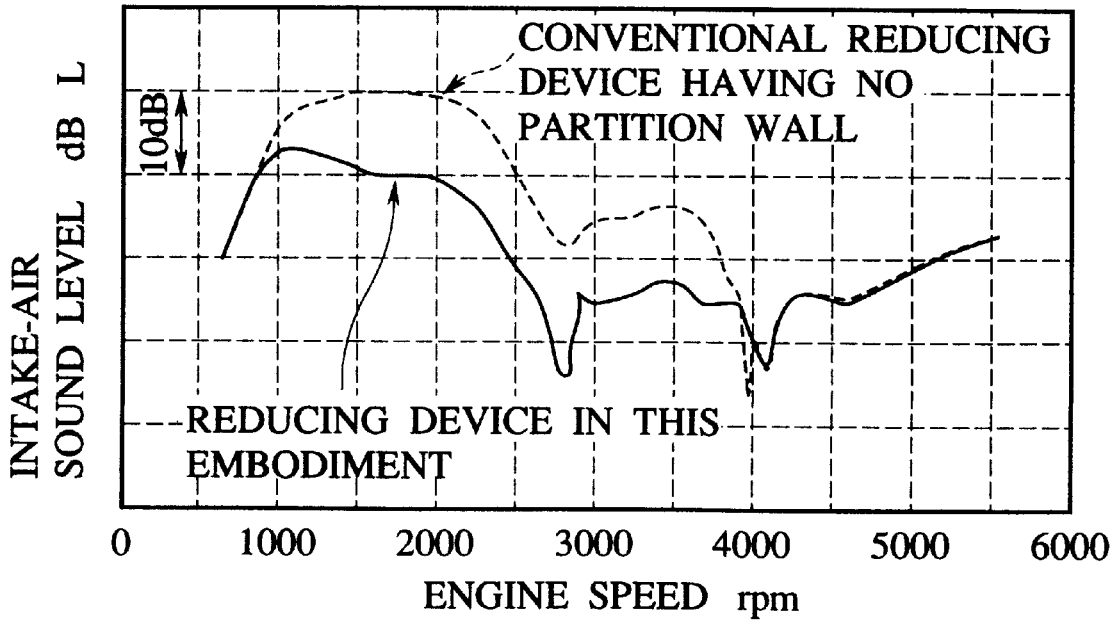
FIG. 17 is a graph showing a proximity noise level when the intake noise reducing device in the fourth embodiment is mounted to an automobile.

FIGS. 16 and 17 are views showing a fourth embodiment of the invention. In the fourth embodiment, a partition wall 24 has about 3L/4 in length. A partition wall starting point is set to a front end 13 of an air introducing duct 23. A valve 18 is offset to the front end 13.

In accordance with the fourth embodiment, there is no partition wall 24 in a portion near a base end 17 of the air introducing duct 23. Thus, an inserting structure of the base end 17 and a projecting member 25 on an air cleaner 10 is easily formed by increasing a diameter of the base end 17.

FIG. 17 shows measured results of a proximity sound near the front end 13 of the air introducing duct 23 within the engine room on which an intake noise reducing device in the fourth embodiment is mounted. These data are resultantly obtained by controlling an operation of the intake noise reducing device such that the valve 18 is opened at an engine speed equal to or greater than 4000 rpm. From FIG. 17, it is understood in comparison with a conventional structure having no partition wall that the intake noises of secondary components of the engine rotation are greatly reduced in a wide range equal to or smaller than 4000 rpm.

Figure 18:
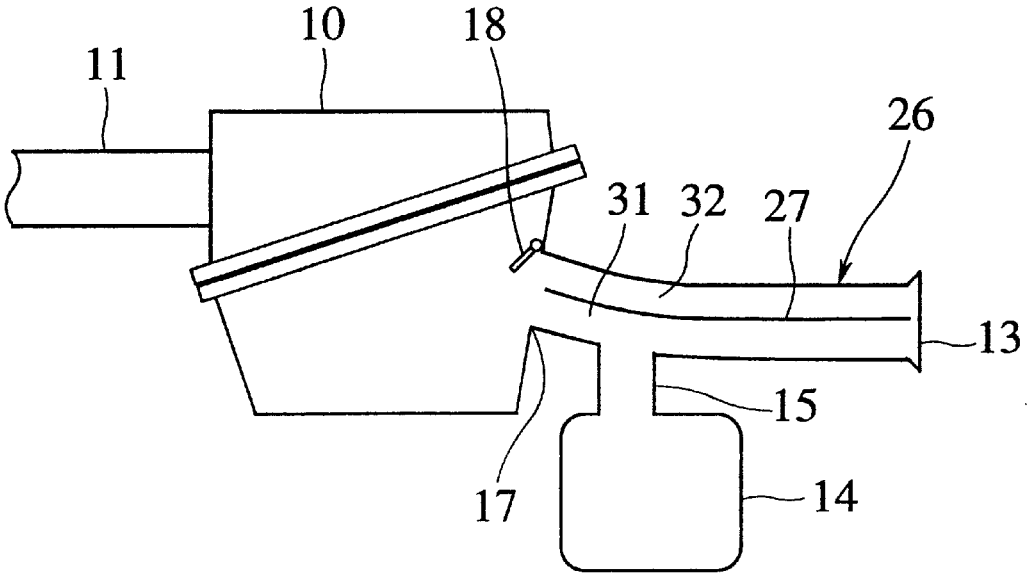
FIG. 18 is a cross-sectional view showing an intake noise reducing device in a fifth embodiment of the present invention.

FIG. 18 is a view showing a fifth embodiment of the invention. In the fifth embodiment, a partition wall 27 has about 3L/4 in length. A partition wall starting point is set to a base end 17 of an air introducing duct 26. A valve 18 is arranged at the base end 17. A connecting duct 15 of a resonance silencer 14 is offset to the base end 17.

The fifth embodiment is suitable for a case in which a position of the resonance silencer 14 is relatively offset to an air cleaner in view of layout within the engine room. Silencing performance on a low frequency side is slightly excellent as peculiar effects obtained by offsetting the resonance silencer 14 to the air cleaner.

Figure 19:
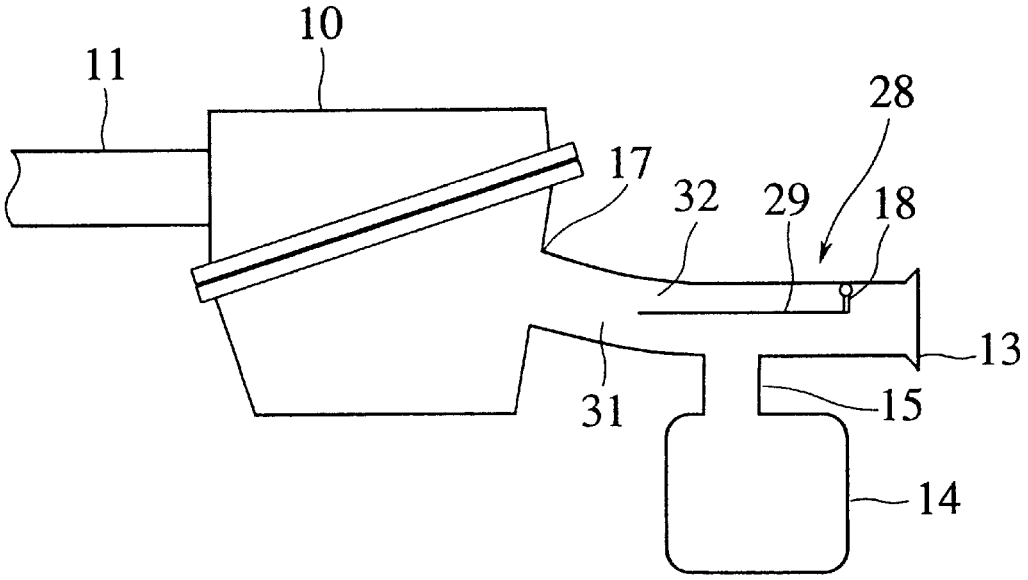
FIG. 19 is a cross-sectional view showing an intake noise reducing device in a sixth embodiment of the present invention.

FIG. 19 is a view showing a sixth embodiment of the invention. In the sixth embodiment, a partition wall 29 having L/2 in length is formed from a position L/4 apart from a front end 13 of an air introducing duct 28 to a position L/4 apart from a base end 17 thereof. A connecting position of a connecting duct 15 to the air introducing duct 28 is opposite to an intermediate position of the partition wall 29. In accordance with the sixth embodiment, reliable silencing performance is obtained at a minimum length (L/2). Further, the connecting position of the connecting duct 15 14 is easily included within a partition wall positioned range even when the length of the partition wall 29 is short.

In each of the above embodiments, each of cross-sectional area ratios of the first and second sections 31, 32 is set to 50%, but there is a case in which these ratios are changed in accordance with the concept of an automobile. The cross-sectional area ratios of the first and sections 31, 32 are changed in accordance with required performance about quietness or maximum horsepower, etc. Thus, in a low load condition, intale noise level is required very very low, the sectional ratio of the first section 31 is set to be small such as about 30%. In contrast, in the case of an automobile having characteristics for securing its output in the low load condition to a certain extent, the sectional ratio of the first section 31 is set to be large such as about 70%. Thus, quietness in intake noises is suitably improved and the engine output is suitably secured in accordance with the characteristics of the automobile.

What is claimed is:

1. An intake noise reducing device for an internal combustion engine, comprising:

an air introducing duct into an internal combustion engine, the duct having a length L;

a partition wall in the duct dividing into first and second sections, the partition wall having a length equal to or greater than L/2;

a silencer;

a connecting duct connecting the first section and the silencer, a connecting position of the connecting duct to the duct being in opposite to the partition wall; and a valve opening and closing the second section.

2. The intake noise reducing device according to claim 1, wherein the duct includes one end connected to the engine, the partition wall extends from the one end of the duct, and the valve is offset to the one end of the duct.

3. The intake noise reducing device according to claim 1, wherein the duct includes one end connected to the engine, and the one end of the duct is disposed out of the partition wall.

4. The intake noise reducing device according to claim 3, wherein the other end of the duct is disposed out of the partition wall.

5. The intake noise reducing device according to claim 1, wherein the duct includes one end connected to the engine, and the connecting position of the connecting duct to the duct is offset to the one end of the duct.

6. The intake noise reducing device according to claim 1, wherein the duct comprises first and second members, a contact portion between the first and second members extends along an axial direction of the duct, the first and second members have first and second joining members being in contact with each other, and the partition wall is included in the first and second joining members.

7. The intake noise reducing device according to claim 1, wherein the duct comprises first and second members, a contact portion between the first and second members extends along an axial direction of the duct, and the partition wall is projected from at least one of the first and second members.

8. The intake noise reducing device according to claim 1, wherein the duct has a substantially oval-shaped cross-section, the partition wall is arranged at a center of the duct.

9. The intake noise reducing device according to claim 1, wherein the engine includes an air cleaner connected to one end of the duct, the partition wall dividing a predetermined interval within the duct into the first and second sections, the first and second sections connect an upstream and a downstream of the predetermined interval in parallel, and the connecting position of the connecting duct to the duct is included in the predetermined interval.

10. The intake noise reducing device according to claim 9, wherein the partition wall extends from the one end of the duct, and the valve is offset to the one end of the duct.

11. The intake noise reducing device according to claim 9, wherein the one end of the duct is disposed out of the predetermined interval.

12. The intake noise reducing device according to claim 11, wherein the other end of the duct is disposed out of the predetermined interval.

13. The intake noise reducing device according to claim 9, wherein the connecting position of the connecting duct to the duct is offset to the one end of the duct.

14. The intake noise reducing device according to claim 9, wherein the predetermined interval has a length equal to or greater than L/2.

15. The intake noise reducing device according to claim 1, wherein the silencer is a resonance type.

16. An intake noise reducing device for an internal combustion engine, comprising:

air introducing means for introducing air into an internal combustion engine, the introducing means having a length L;

partitioning means in the introducing means for dividing into first and second sections, the partition means having a length equal to or greater than L/2;

a silencer;

connecting means for connecting the first section and the silencer, a connecting position of the connecting means to air introducing means being in opposite to the partitioning means; and opening-closing means for opening and closing the second section.

17. An automobile, comprising:

an internal combustion engine;

a air introducing duct into the engine, the duct having a length L;

a partition wall in the duct dividing into first and second sections, the wall having a length equal to or greater than L/2;

a silencer;

a connecting duct connecting the first section and the silencer, a connecting position of the connecting duct to the duct being in opposite to the partition wall; and a valve opening and closing the second section.

* * * * *